United States Patent [19]

Kurtz

[11] 4,378,748

[45] Apr. 5, 1983

[54] SAILBOAT KEEL APPARATUS

[76] Inventor: Joel Kurtz, Box 26, Damascus, Pa. 18415

[21] Appl. No.: 339,985

[22] Filed: Jan. 18, 1982

[51] Int. Cl.[3] ..... B63B 41/00

[52] U.S. Cl. ..... 114/141; 114/124; 114/130; 114/132; 114/344

[58] Field of Search ..... 114/140, 141, 143, 130–137, 114/344, 124–127; 74/104

[56] References Cited

U.S. PATENT DOCUMENTS

| | | | |
|---|---|---|---|
| 292,031 | 1/1884 | Mills et al. | 114/137 |
| 492,022 | 2/1893 | Jessup | 114/137 |
| 2,515,564 | 7/1960 | Mercer et al. | 114/344 |
| 3,179,078 | 4/1965 | Popkin | 114/126 |
| 3,226,738 | 1/1966 | Fox | 9/1 |
| 3,227,123 | 1/1966 | Voigt | 114/344 |
| 3,430,595 | 3/1969 | Tulleners | 114/61 |
| 3,696,684 | 10/1972 | Estlick | 74/104 |
| 3,903,827 | 9/1975 | Marcil | 114/143 |
| 3,951,090 | 4/1976 | Potter | 114/141 |
| 3,996,875 | 12/1976 | Isenberg, Jr. | 114/144 R |
| 4,044,703 | 8/1977 | Kurtz | 114/143 |
| 4,117,797 | 10/1978 | Kelly et al. | 114/143 |

FOREIGN PATENT DOCUMENTS

| | | | |
|---|---|---|---|
| 266680 | 1/1964 | Australia . | |
| 2254205 | 5/1974 | Fed. Rep. of Germany | 114/143 |
| 2010005 | 2/1978 | Fed. Rep. of Germany . | |
| 2751364 | 5/1979 | Fed. Rep. of Germany | 114/140 |
| 2449030 | 10/1980 | France | 114/140 |
| 55-91481 | 7/1980 | Japan | 114/140 |
| 334508 | 1/1959 | Switzerland | 114/344 |
| 388803 | 2/1965 | Switzerland . | |
| 1005758 | 9/1965 | United Kingdom | 114/127 |

OTHER PUBLICATIONS

International App. No. PCT/GB78/0014 to Sugden.

*Primary Examiner*—Trygve M. Blix
*Assistant Examiner*—C. T. Bartz
*Attorney, Agent, or Firm*—Jack D. Slobod

[57] ABSTRACT

A sailboat carries a pair of opposed keel sections which are angularly positionable about a common hinge axis, either as a keel unit or individually, by means of compressed air biased hydraulic actuators connected via shock absorbers to the keel sections. An additional hydraulic actuator, adjusts the angle of elevation of the hinge axis, enabling the keel unit or sections, when inclined, to provide hydrodynamic lift. The keel sections, which are hollow and contain radially flowable ballast, are configured, when oppositely horizontally positioned to receive the axles of removable wheels, enabling the boat to be self-trailered.

26 Claims, 17 Drawing Figures

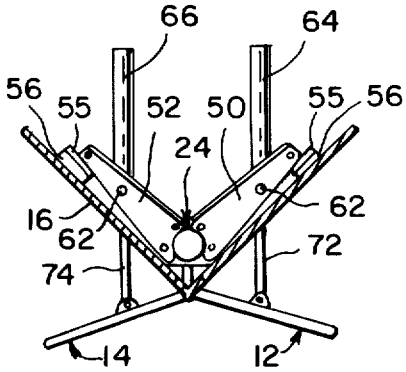
Fig. 3
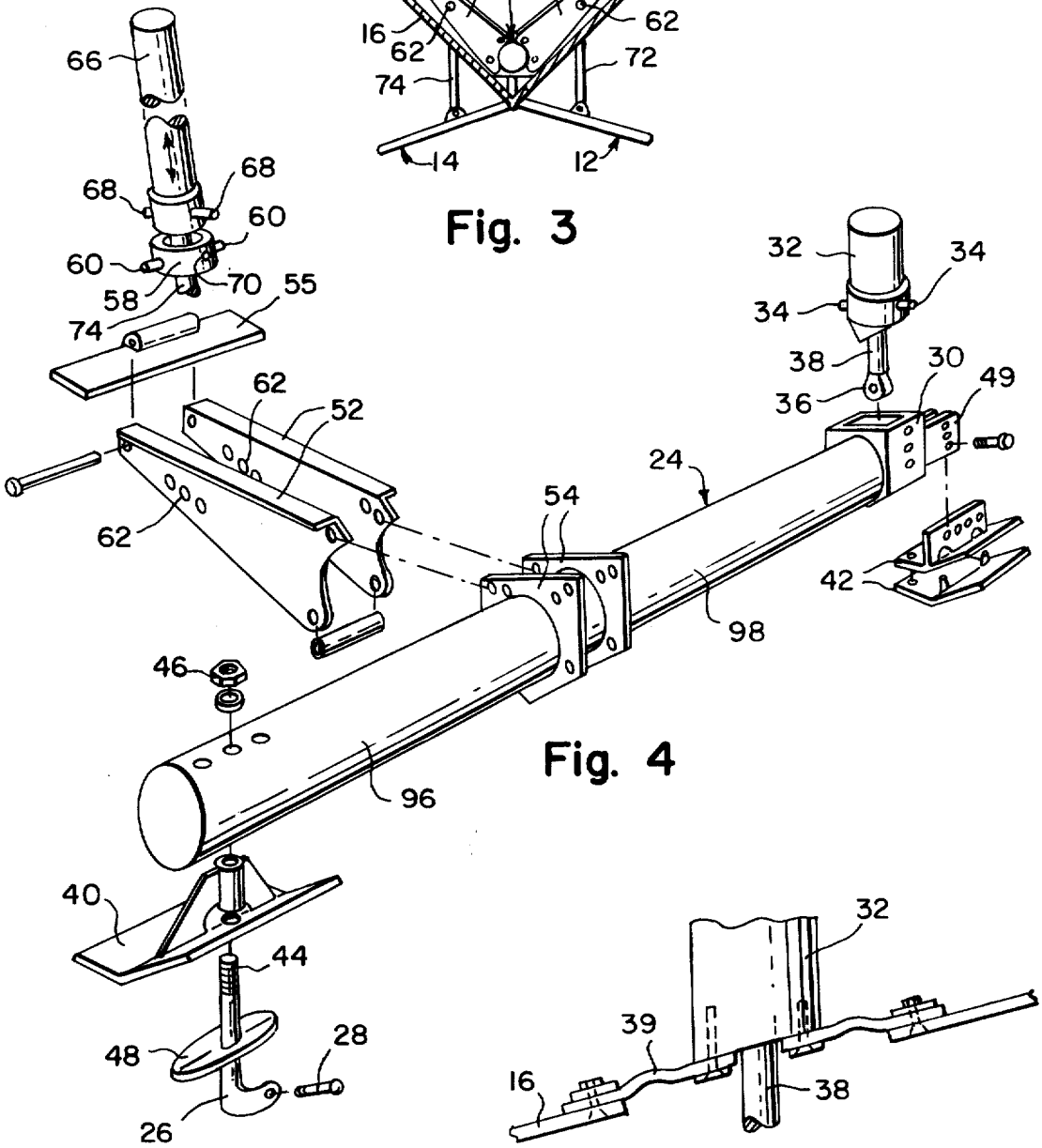
Fig. 4
Fig. 5

SAILBOAT KEEL APPARATUS

FIELD OF THE INVENTION

The present invention relates generally to sailboats which utilize an angularly positionable keel means to provide a moment opposing the heeling moment applied to the sail area while the sailboat remains substantially upright. In one of its particular aspects, the present invention relates to such an angularly positionable keel means substantially rigidly positioned. In another of its particular aspects, the present invention relates to the provision of means for adjusting the positioning of the axis of the keel means enabling the keel means when inclined to provide hydrodynamic lift.

BACKGROUND TO THE INVENTION

Generally, the conventional sailboat keel is rigid and by providing a low center of gravity serves to oppose the heeling moment applied to the sail area only by the action of the boat in heeling over. In my prior patent, U.S. Pat. No. 4,044,703, granted Aug. 30, 1977, I disclosed a keel design which included a pair of complementary keel sections which could be angularly positioned either independently or as a locked together unit for exerting a moment opposing the heeling moment applied to the sail area and allowing the boat to remain upright. By the boat remaining upright, the horizontal component of wind force upon the sail area is maximized. The angle between the keel sections determines the draft and roll moment of inertia of the boat, while the orientation of the bisector of the angle between the keel sections determines generally the moment opposing the heeling tendency. That design utilized flexible lines to support the keel sections at desired orientations such that any upward forces applied to the keel sections would not be transmitted to the hull of the boat since the keel sections alone would tend to rotate upward. That feature is desireable in terms of eliminating shock to the hull as from a grounding.

However, according to my present invention, by utilizing means to variably position and hold the keel sections substantially rigidly positioned so that the keel can transmit upward forces to the hull, various useful and novel features are possible.

As one feature, the axis of the keel may be adjusted in elevation so that hydrodynamic lift and yaw forces are applied to the inclined keel means by means of reaction of the water upon the moving sailboat so as to provide desireable lift of the boat and yaw toward the wind, referred to as "lift to windward".

In a second feature, the keel sections may be configured to accept removable wheels to enable the boat to be self-trailered.

DESCRIPTION OF THE PRIOR ART

In addition to my prior patent, the utilization in a sailboat of independently angularly moveable fins was proposed by Emcken in Australian Pat. No. 266,680. U.S. Pat. No. 3,996,875 to Isenberg, Jr., discloses a hydraulic system for retracting a centerboard and U.S. Pat. No. 3,226,738 to Fox discloses a self-trailering boat in which a fin assembly in a pontoon well may be interchanged with a wheel assembly. I am not aware of any prior art disclosing angularly positionable keel means positioned by a hydraulic actuator nor any prior art disclosing a keel axis with a variable angle of elevation.

OBJECTS OF THE INVENTION

It is an object of the present invention to provide a pivotally mounted sailboat keel means which is positionable in a variable angular position but maintainable substantially rigid in said variable position.

It is a further object of the present invention to provide means for varying the elevation angle of the axis of the keel means, in order that the keel means when inclined can be provide hydrodynamic lift.

It is yet another object of the present invention to provide a pair of complementary opposed angularly positionable keel sections with actuator means connected to the keel sections for holding the keel sections at desired angular positions.

It is still another object of the present invention, to provide first control means coupled to the actuator means for influencing primarily the angle between the keel sections and second control means coupled to the actuator means for influencing primarily the orientation of the bisector of the angle between the keel sections.

It is an additional object of the present invention to configure the keel sections to accept removeable wheels so that the boat may be self-trailered.

SUMMARY OF THE INVENTION

Briefly, the aforementioned and other objects of the present invention are satisfied by providing a generally longitudinally directed keel axis mounted pivotally at one end for downward elevational angulation at a medial point on the underside of a sailboat. First positioning means, namely a hydraulic actuator, positions the other end of the keel axis. Port and starboard facing opposed keel sections comprising a keel means are mounted for angulation about the keel axis, and a second positioning means, namely port and starboard hydraulic actuators, are connected respectively to the keel sections for adjusting the angular positions of the keel sections. Since the hydraulic actuators hold the keel sections substantially rigidly in the desired orientations, shock absorbers are formed at the points of interconnection between the port and starboard hydraulic actuators and the keel sections to attenuate transmission of shock forces from the keel sections to the hull.

The port and starboard hydraulic actuators comprise slave hydraulic cylinders which are respectively hydraulically coupled to port and starboard master cylinders within the boat. The pistons of the master cylinders are coupled mechanically by a first control means which moves the pistons to increase the hydraulic volume of one of the master cylinders while decreasing the hydraulic volume of the other master cylinder. This has the effect of varying the orientation of the bisector of the angle between the keel sections without substantially varying the angle between the keel sections. Differently stated, the first control means causes the keel sections to rotate in the same direction.

A second control means, configured as a hydraulic pump and bleeder system for simultaneously increasing or simultaneously decreasing the hydraulic fluid in the port and starboard master and slave cylinders, causes the keel sections to rotate in opposite directions and thereby controls the angle between the keel sections.

A further feature of the invention is that the port and starboard hydraulic cylinders are biased with compressed air carried in storage tanks. The biasing forces tend to rotate the keel sections upward and are sufficient to maintain the keel sections above horizontal orientation in the absence of hydraulic pressure to the port and starboard actuators. This reduces the amount of work required to raise the keel sections when the boat is removed from the water. In order to somewhat lighten the keels when they are rotated above horizontal, the keels are hollow and contain flowable ballast which flows or migrates from the keel extremity toward the keel axis when the keel sections are so rotated.

The keel sections, at their ends, include openings for receiving the axles of removeable wheels, allowing the boat to be self-trailering.

Other objects, feature, and advantages of the present invention will become apparent upon perusal of the following detailed description of the best mode of carrying out the invention when taken in conjunction with the appended drawing.

BRIEF DESCRIPTION OF THE DRAWING

FIG. 3, is transverse cross-sectional view of the lower part of the sailboat in FIG. 1 at a point just in front of the keel;

FIG. 4, is an exploded pictorial view of the parts shown in FIGS. 2 and 3 for manipulating one of the keel sections including an actuator at its upper left.

FIG. 5, is a fragmentary side elevational cross-sectional view of the actuator shown is the upper left of FIG. 4, taken in the vicinity of the boat hull;

DETAILED DESCRIPTION OF THE PREFERRED EMBODIMENT

Figure 1:
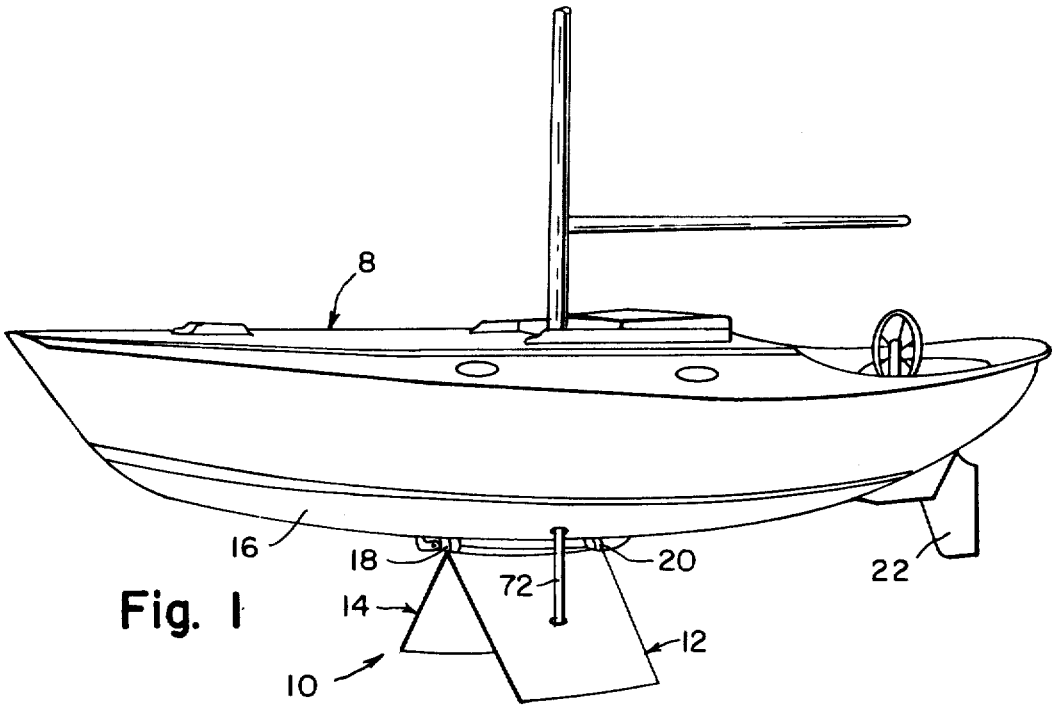
FIG. 1, is a pictorial view, generally in side elevation, of a sailboat having the opposed keel sections of the present invention.
Figure 2:
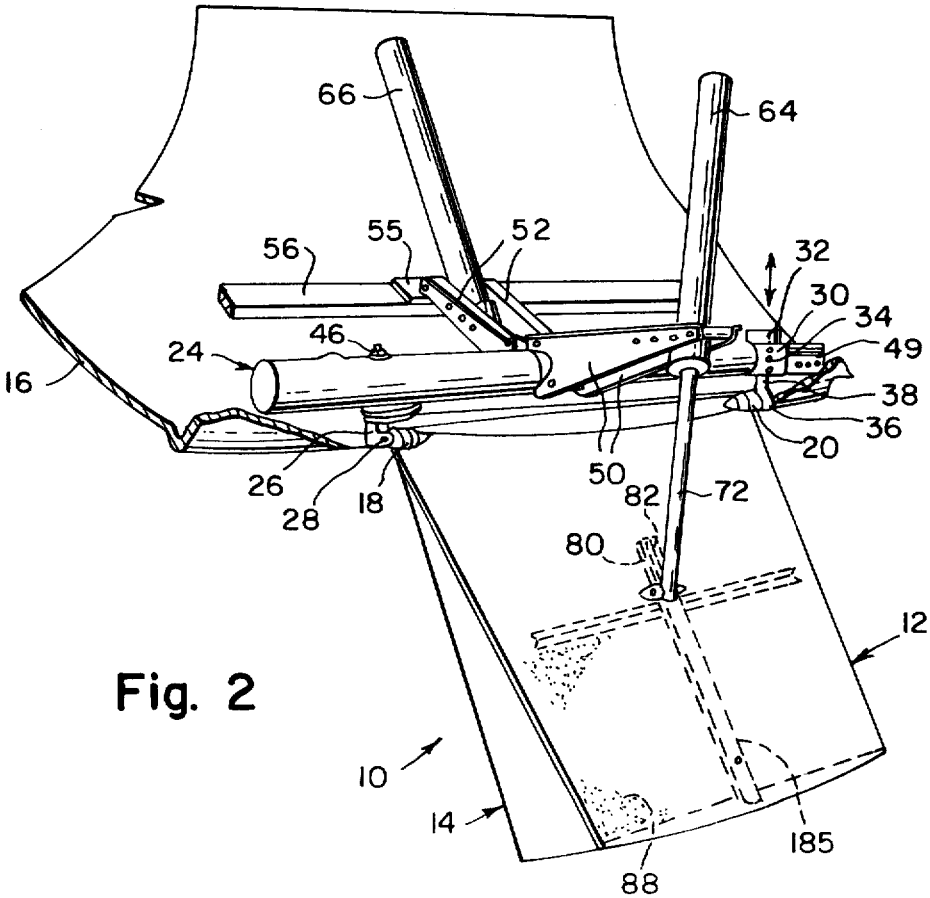
FIG. 2, is a pictorial cutaway view of the sailboat in FIG. 1, viewing the area proximate the keel sections from a position intermediate the side and front of the boat.

Referring first to FIG. 1 of the drawing there is illustrated a sailboat having a keel means 10 comprising port and starboard opposed keel sections 12 and 14 pendant from the underside of the hull 16 of boat 8. Keel sections 12 and 14 are carried from and are each mounted for angulation about a common hinge axis comprising colinear forward and aft hinges 18 and 20. In addition to the keel means 10, sailboat 8 has the usual controls such as a rudder 22.

The manner of physically supporting keel means 10 may be discerned from FIGS. 2 through 4 and 7. As shown, there is formed a longitudinally directed central rigid spine member 24 within and along the deepest part of hull 16 through which is vertically directed a foreward hanger 26. A front hinge 18 carries a flange 19 which is pivotally mounted to forward hanger 26 by means of pin 28. A box member 30, mounted at the rear of spine member 24, has a hydraulic cylinder 32 mounted therethrough for angulation about axles 34. The shaft 38 of cylinder 32 passes through an elastomeric seal 39 (FIG. 5) mounted in hull 16 and a yoke 36 forward at the external end of shaft 38 carries aft hinge 20. It should now be apparent that the hydraulic cylinder 32 may variably vertically positions aft hinge 20, causing forward hinge 18 to pivot about pin 28, to form a variable angle between the longitudinal axis of boat 8 and the keel hinge axis comprising the line between hinges 18 and 20.

Spine member 24, is mounted at its forward and aft ends to boat hull 16 by means of angular bracket elements 40 and 42. Forward angular bracket 40 has a threaded shaft 44 of front hanger 26 passing therethrough and through spine member 24 and then secured in place by means of nut 46. Shaft 44 carries a seal 48 to cooperate with the underside of hull 16. Aft brackets 42, which are sandwiched about hull 16, are bolted to a flange 49 at the aft end of spine member 24.

Spaced apart pairs of port directed arms 50 and starboard directed arms 52 are bolted to flanges 54, located centrally for spine member 24, at an angle accomodating the shape of hull 16. Plates 55 are pinned to the remote ends of arms 50 and 52 and secured to elongated wooden beams or strongbacks 56 directed longitudinally along the interior sides of hull 16. Between arms 50 and 52 are respectively located downwardly directed port and starboard hydraulic cylinders 64 and 66 which may rock in both pitch and roll. As will become apparent, both degrees of freedom are necessary in view of the movements of the keel axis and keel sections. This mounting is accomplished by means of collars 58 having integral longitudinally directed axles 60 passing through holes 62 in the arms 50 and 52 permitting the collars to angulate in the roll direction and the port and starboard slave cylinders or actuators 64 and 66 each having integral axles 68 mounted through holes 70 in the collars 58 to angulate relative to the collars in the pitch direction.

Figure 9:
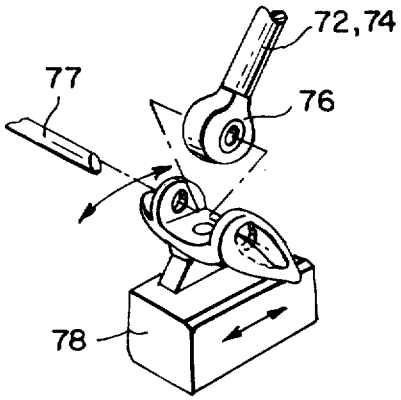
FIG. 9, is an enlarged pictorial detail of a part carried by the keel sections in FIG. 7.
Figure 7:
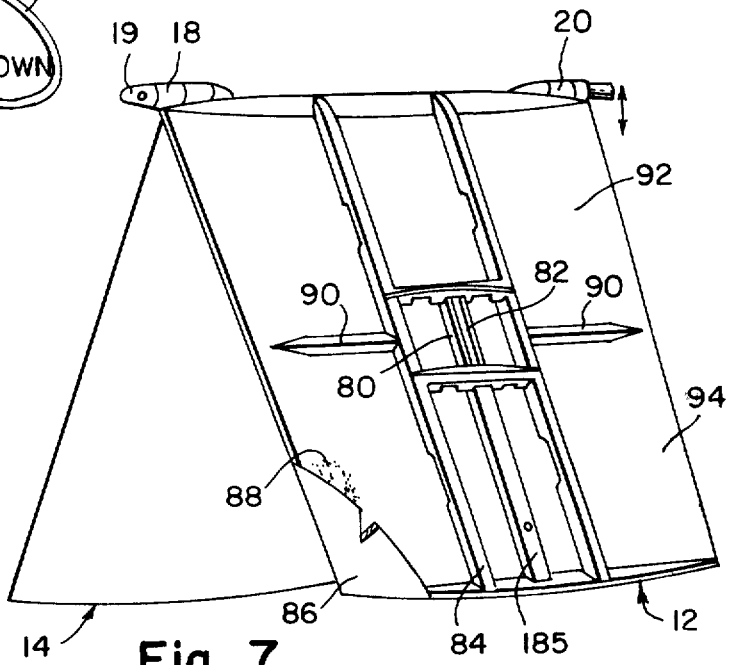
FIG. 7, is a broken away pictorial elevational view generally from the side of the keel sections shown in FIG. 1.

The shafts 72 and 74 of slave cylinders 64 and 66 pass sealably through hull 16 and at their downward ends are formed yokes 76 (FIG. 9) which are pinned (by means of pins 77) to blocks 78 which in turn are captured by the keel sections 12 and 14. As shown in FIG. 7, blocks 78 slide in radially directed tracks 80 within the keel sections. Tracks 80 have a relatively narrow opening 82 such that ambient water, normally in the tracks at opposite ends of the blocks 78, escapes slowly as the blocks slide, creating viscous frictional forces opposing the sliding movement. This acts as a shock absorber means.

It should now be apparent that as the shafts 72 and 74 are extended from or retracted into the respective slave cylinders 64 and 66, the positions of keel sections 12 and 14 about the keel axis composed of hinges 18 and 20 may be individually controlled. The movement of blocks 78 in tracks 80, however provide some desireable dead zone in this mechanism allowing shocks applied to the keel sections 12 and 14 not to be transmitted to the shafts of the slave cylinders 64 and 66.

Figure 8:
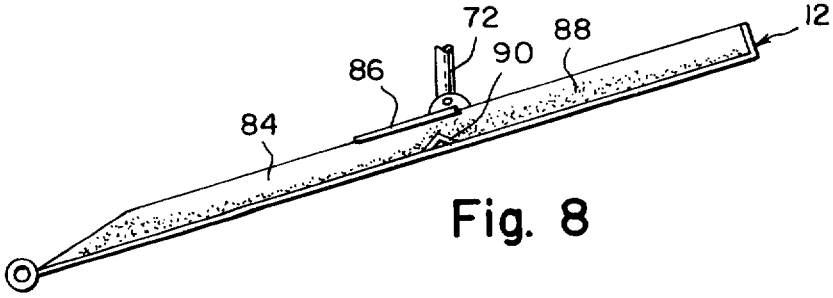
FIG. 8, is a cross-sectional front view of one of the keel sections of FIG. 8, but positioned rotated upward.

As is also apparent from FIG. 7 and FIG. 8, the keel sections are composed of an inner network of metal ribs 84 including tracks 80, over which is applied a metal skin 86. For ballast, the keel sections are filled with a mixture 88 of oil and metal shot which is flowable. The rib network 84 includes longitudinally directed baffles 90, dividing the interior of the keel sections into a half 92 proximate hinges 18 and 20 and a half 94 proximate the ends of the keel sections. With the keel sections in the usual operating position, pointing below horizontal, the flowable ballast 88 is located in the half 94 proximate the ends of the keel sections. However, when the keel sections 12 or 14 are raised above horizontal the ballast flows due to gravity radially inward past baffles 90 and toward the hinges 18 and 20, thereby reducing the upward forces needed to be exerted by cylinders 64 and 66 to maintain the keel sections upwardly directed.

Figure 6:
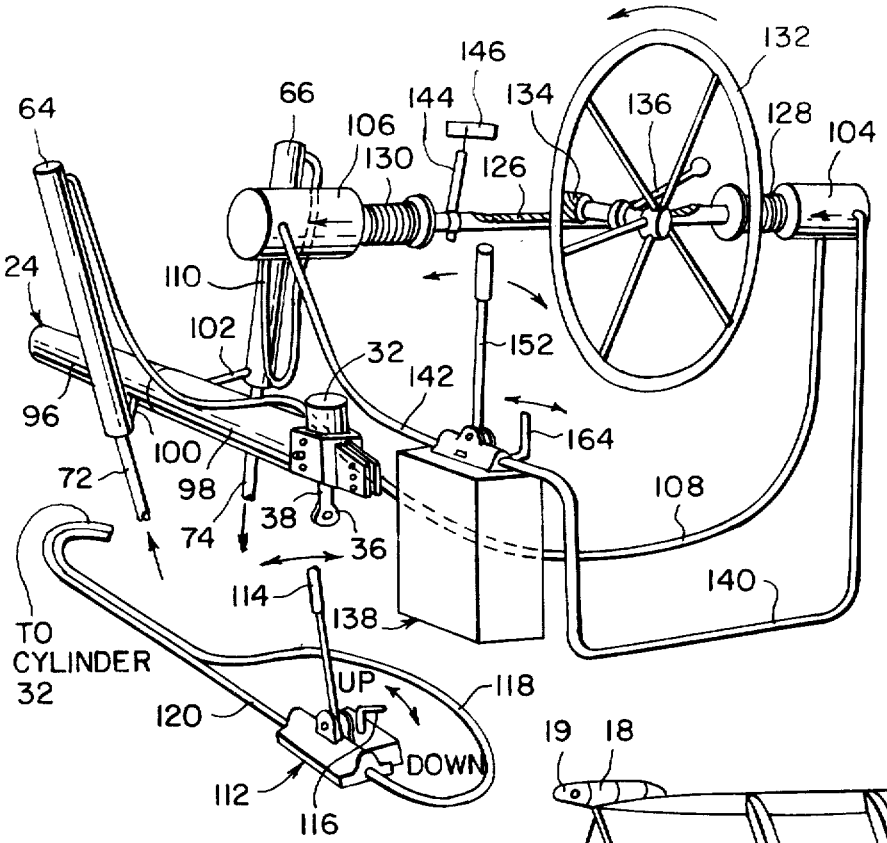
FIG. 6, is a pictorial presentation of the controls for the keel apparatus of the present invention.

As shown in FIG. 6, the spine member 24 is hollow and is segmented into two tanks 96 and 98 each for storing compressed air. The cylinders 64 and 66 receive air pressure respectively from tanks 96 and 98 respectively via tubes 100 and 102 directed to the lower ends of the cylinders for exerting forces tending to raise the keel sections 12 and 14 upward to the position shown in FIG. 8. The upper ends of slave cylinders 64 and 66 receive hydraulic pressure respectively from master cylinders 104 and 106 via tubes 108 and 110 for exerting forces to angulate the keel sections downward into operating position. In the absence of these hydraulic pressures, the aforementioned air pressures are of sufficient magnitude to bias the keel sections 12 and 14 to be angularly directed upward along opposite sides of boat 8.

The hydraulic cylinder 32 which controls the elevation of the hinge axis for keel sections 12, 14 is controlled by means of a reversible hand operated pump 112 included a reciprocating handle 114, and reversing control 116. The output tubes 118, 120 of pump 112 are respectively coupled to the upper and lower ends of cylinder 32 for selectively transferring hydraulic fluid between the upper and lower ends of the cylinder. Thus, by selecting the direction of fluid transfer, by means of reversing control 116, and by thereafter reciprocating pump handle 114, the yoke 36 may be selectively moved upward or downward to position the angle of the hinge axis for the keel sections as desired.

With reference to FIG. 6, and FIGS. 15 through 17, the control means for positioning keel sections 12 and 14 about the keel axis defined by hinges 18, 20 will now be understood. The master cylinders 104 and 106 respectively have pistons 122 and 124 which coupled mechanically by means of a rack 126 having springs 128 and 130 at either end. A control wheel 132 coaxially carries a pinion 134 and cooperates with a brake or locking mechanism including an actuating handle 136. As the wheel 132 is rotated by hand, in a selected direction, pinion 134 shifts rack 126 to increase the hydraulic volume of one of master cylinders 104 and 106 and simultaneously decrease the hydraulic volume of the other of the master cylinders by the same amount. As the discussion proceeds, it will become apparent that when a pump 138, coupled to the master cylinders 104 and 106, respectively by tubes 140 and 142, is not operated, the total hydraulic fluid contained by port slave cylinder 64 and port master cylinder 104 is a constant and similarly the total hydraulic fluid contained by starboard slave cylinders 66 and starboard master cylinder 106 is a constant. Therefore, the shifting of rack 126 causes hydraulic fluid to be transferred into one of the slave cylinders 64 and 66 from its associated master cylinder and to be removed from the other of the slave cylinders to its associated master cylinder. This results in a selected one of shafts 72 and 74 being extended and the other of shafts 72 and 74 being retracted by the same amount causing each of the keel sections 12 and 14 to change position by rotation in the same direction. This may be thought of as an angular shift of the entire keel means 10 or as an angular shift of the bisector between the keel sections 12 and 14. The wheel 132 may be rotated to any desired position and locked in place by means of brake handle 136. An indicator needle 144 carried by rack 126 cooperates with a fixedly positioned scale 146 to indicate the angle of the keel means.

Figure 13:
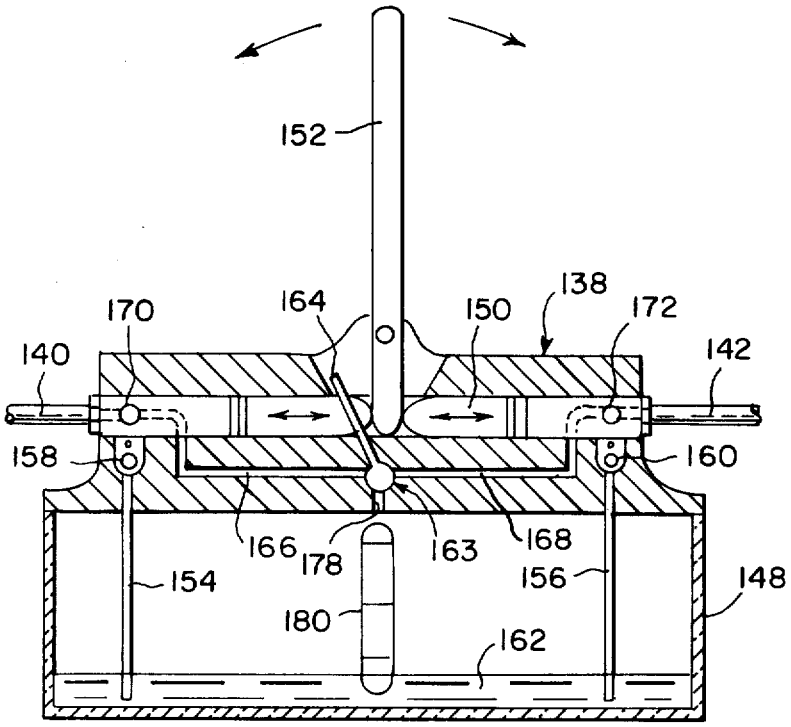
FIG. 13, is a detailed cross-sectional elevational view of a pump shown in FIG. 6.
Figure 14:
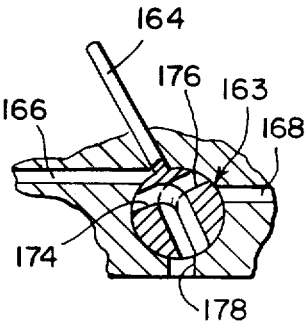
FIG. 14, is a detailed cross-sectional view of a portion of the pump shown in FIG. 13.

The keel sections 12 and 14 are simultaneously rotated in opposite directions, either towards or away from each other, by means of pump 138. Pump 138 is of a well known double type shown in FIGS. 13 and 14 which includes a common transparent reservoir casing 148 and a reciprocating piston 150 operated by pump handle 152. Pump 138 further includes reservoir intakes 154 and 156 respectively having associated check valves 158, 160. As handle 152 is stroked in one direction, hydraulic fluid 162 from reservoir casing 148 is pumped into one of tubes 140 and 142 and when stroked in the opposite direction, hydraulic fluid is pumped into the other of tubes 140 and 142. Thus, when the handle 152 is reciprocated back and forth hydraulic fluid is pumped alternately into tubes 140 and 142. However, check valves 158 and 160 serve to isolate the tubes 140 and 142 so that the pressures therein need not be the same.

Pump 138 also has a rotary bleed control 163 including a handle 164. Bleed control 163 is coupled to tubes 140, 142 respectively by means of channels 166 and 168 which respectively cooperate with check valves 170 and 172. The rotary portion of the control includes channels 174, 176 which, when handle 164 is vertical, respectively align with channels 166 and 168 and couple them to an opening 178 for hydraulic fluid to fall into reservoir casing 148 from the channels 166 and 168. However, when handle 164 is rotated to vertical to initiate bleeding of hydraulic fluid from tubes 140 and 142 into reservoir 148, the tubes 140 and 142 remain isolated due to check valves 170 and 172. Thus pump 138 can simultaneously pump hydraulic fluid to master cylinders 104 and 106 or bleed hydraulic fluid therefrom while allowing the master cylinders to have different fluid pressures.

Figure 15:
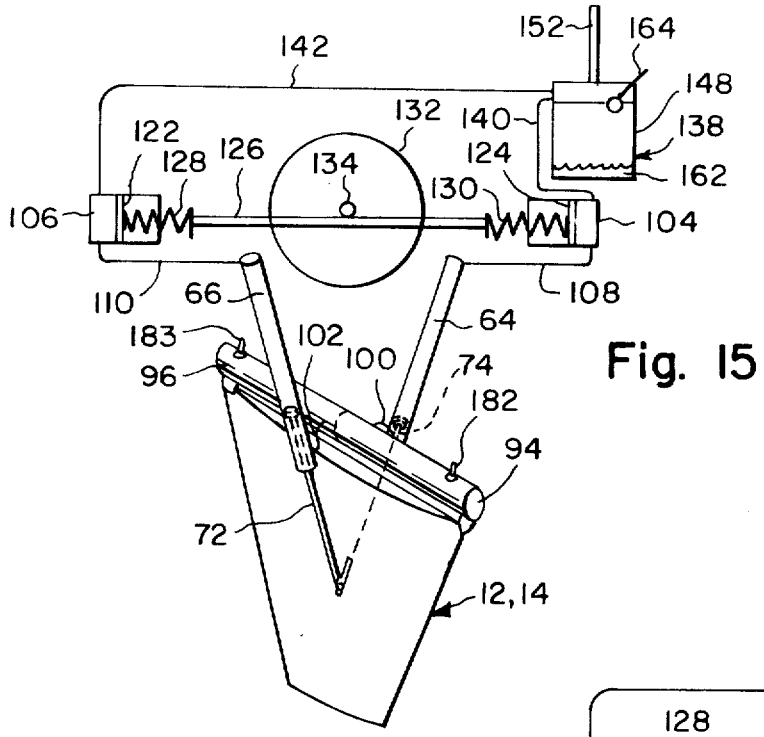
FIG. 15, is a schematic and pictorial view of the keel sections and control means with the keel sections positioned generally vertically.

As fluid is pumped into the master cylinders 104 and 106 from pump 138 and conveyed to slave cylinders 64 and 66 by means of tubes 108 and 110, the keel sections 12 and 14 can be brought together as shown in FIG. 15 and still further pumping of pump 138 causes springs 128 and 130 to compress and support hydraulic pressure in the master cylinders. This hydraulic pressure serves to hold the keel sections against other. The spring forces are reflected upon the slave cylinder shafts through the ratio of the diameters of the master and slave cylinders.

Figure 17:
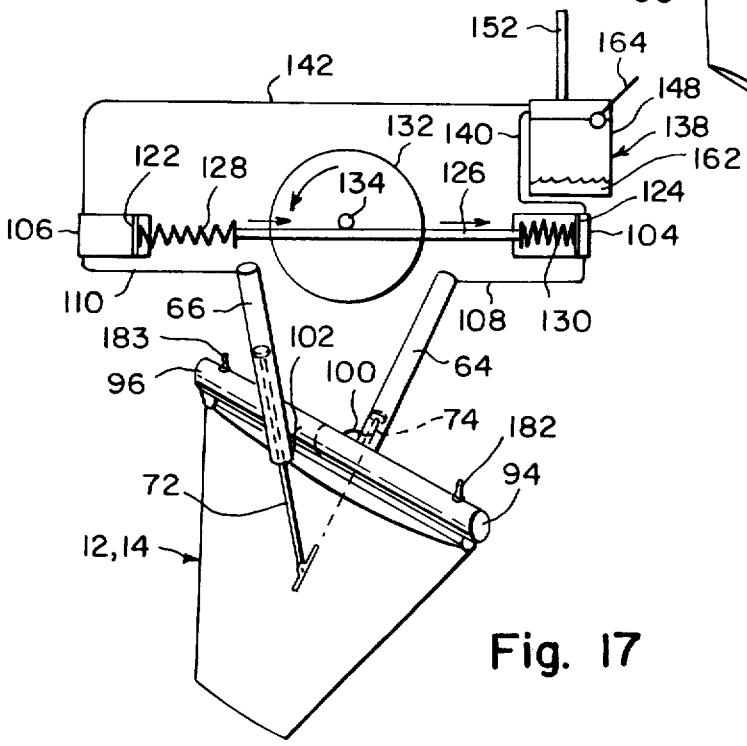
FIG. 17, is a schematic and pictorial view, similar to FIG. 16, but with the keel sections as a unit being positioned to one side of vertical.

In FIG. 15, the keel sections 12 and 14, are illustrated as against each other. The wheel 132 is locked in a central position. The low level of hydraulic fluid 162 reservoir casing 148 indicates, in cooperation with a scale 180 (FIG. 13) on casing 148, that the keel sections are together. The keel sections 12 and 14 as a unit may be rotated to either side of vertical by unlocking and rotating wheel 132 to a desired angular position as shown in FIG. 17. This position is utilized to oppose the heeling movement of wind forces applied to the sails to allow boat 8 to remain upright.

Figure 16:
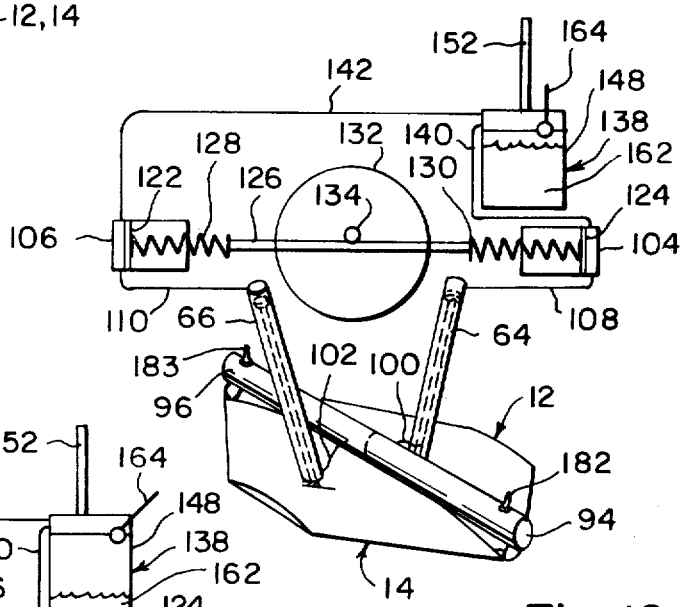
FIG. 16, is a schematic and pictorial view, similar to FIG. 15, but with the keel sections positioned rotated above horizontal.

Similarly, the wheel 132 may be locked in a central position and the handle 164 rotated to vertical and kept in that position as shown in FIG. 16 to cause the hydraulic fluid to bleed to reservoir casing 138 and for the keel sections to rotate in opposite directions to positions above horizontal and directed upward alongside the hull of the boat 8. The relatively high level of hydraulic fluid 162 in casing 138 indicates on scale 180 that the keel sections are "full up." The storage tanks 96 and 98 respectively have intake valves 182 and 183 via which the tanks are initially pressurized with compressed air to insure that the keel sections 12 and 14 may be raised to this position by the air pressure.

It should be apparent that a full range of intermediate positions of the keel sections 12 and 14 are possible such as positions with the keel sections apart and with the bisector between the keel sections at an angle with the vertical for both reducing the draft of the boat and opposing the aforementioned heeling momement. It need only be understood, that the wheel 132 controls the angle of the bisector between the keel sections 12 and 14 and the pump 138 controls the angle between the keel sections and that pump 112 (FIG. 6) controls the elevation angle of the axis about which the keel sections rotate.

Figure 10:
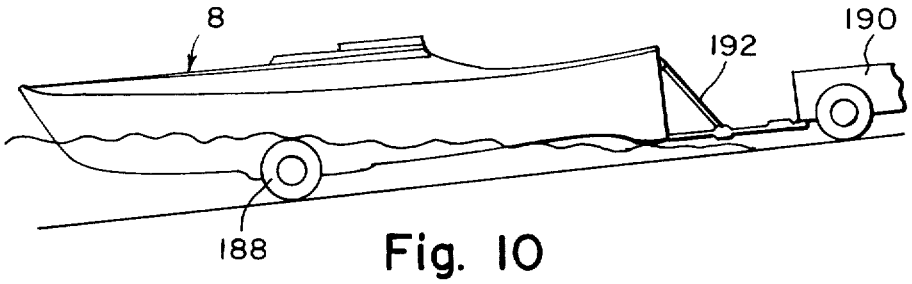
FIG. 10, is a side elevational view of the sailboat of FIG. 1, with the keel apparatus of the present invention having wheels attached for self-trailering.
Figure 11:
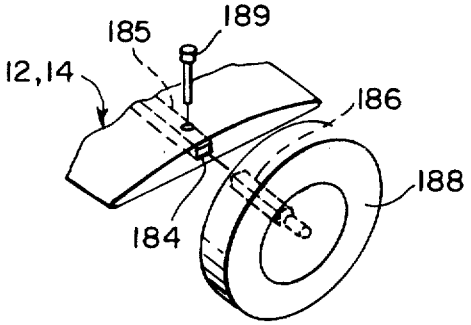
FIG. 11, is a fragmentary pictorial exploded view of one of the keel sections in conjunction with a removeable wheel.
Figure 12:
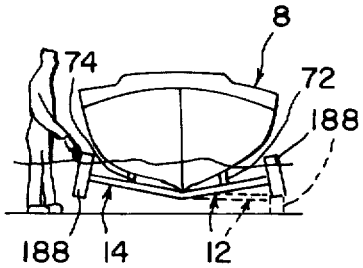
FIG. 12, is a front elevational view of the sailboat of FIG. 10, showing the manner of removing the wheels.

The use of the slave cylinders 64 and 66 for holding the keel sections 12 and 14 substantially rigidly at desired orientations not only allows hydrodynamic lift to be transmitted to the hull 16 of boat 8 when the hinge axis composed of the line between front hinge 18 and aft hinge 20 is inclined below horizontal, but also allows the boat to be self-trailering. As illustrated in FIGS. 10 through 12, the end of each keel section 12 and 14 has an opening 184 into a central hollow rib 185 within the keel section. Hollow rib 185 accepts a removeable shaft 186 of rectangular cross-sections which serves as an axle for wheel 188. Shaft 186 is locked in place by means of a pin 189 which passes cross-wise through the keel sections 12 and 14 and shaft 186.

The wheel and axle assemblies, as shown in FIG. 12, are attached to or removeable from keel sections 12 and 14 when the boat 8 is in shallow water and the keel sections 12 and 14 are positioned rotated above horizontal. When the keel sections are horizontal the wheels 188 will support boat 8 on land and as shown in FIG. 10, allowing the boat to be pulled by a vehicle 190 by means of a removeable hitch 192 attached to the stern of boat 8. It should also be apparent that no dock is necessary since the boat 8 can simply be rolled into the water and the keel sections 12 and 14 then rotated upwards to permit the boat to float and the wheels 188 to be removed. The boat 8 can similarly be pulled from the water.

While the preferred embodiment of the present invention has been described herein in particular detail, it should be noted that numerous additions, omissions and modifications in detail are possible within the intended spirit and scope of the invention.

What is claimed is:

1. In a boat, attitude control apparatus comprising a keel axis mounted for elevational angulation at a medial point on the underside of said boat; first positioning means coupled to said keel axis for adjusting the elevation angle between said keel axis and the longitudinal axis of said boat and for maintaining said keel axis in fixed orientation, after adjustment, relative to the longitudinal axis of said boat; a keel means pendant from said keel axis for angulation about said fixedly oriented keel axis; and second positioning means coupled to said keel means for adjusting the angular position of said keel means about said keel axis.

2. The apparatus of claim 1 wherein said keel means comprises port and starboard facing angularly opposed keel sections each independently angularly positionable about said keel axis; and wherein said second positioning means includes a port keel section positioning actuator coupled to said port facing keel section and a starboard keel section positioning actuator coupled to said starboard facing keel section.

3. The apparatus of claim 2, wherein, said port and starboard keel section positioning actuators respectively comprise opposed port and starboard hydraulic slave cylinders; said apparatus further comprising port and starboard hydraulic master cylinders within said boat respectively hydraulically coupled to said port and starboard slave cylinders, each of said master cylinders having a piston, first control means coupled between the pistons of said port and starboard master cylinders for simultaneously increasing the hydraulic volume of a selected one of said master cylinders and decreasing the hydraulic volume of the other of said master cylinders for selectively causing said port and starboard facing keel sections to rotate angularly in the same direction about said keel axis and second control means comprising hydraulic pump means coupled hydraulically to each of said master cylinders for selectively causing said port and starboard facing keel sections to rotate angularly in opposite directions about said keel axis.

4. The apparatus of claim 2, wherein said port and starboard keel section positioning actuators comprise cylinders for receiving opposed hydraulic and air pressures, said cylinders being directed for angularly downwardly rotating said keel sections in response to an excess of hydraulic pressure with respect to air pressure and angularly upwardly rotating said keel sections in response to an excess of air pressure with respect to hydraulic pressure; control means within said boat coupled for applying selected hydraulic pressures to said cylinders; and air pressure storage tank means within said boat coupled for applying air pressure to said cylinders; whereby said keel sections may be raised in opposite directions by air pressure from said storage tank means upon the application of no or relatively small hydraulic pressures from said control means.

5. The apparatus of claim 2, wherein the end of each keel section is configured to carry the axle of a removeable tractive wheel to enable the boat to be supported and moved on land.

6. The apparatus of claim 1, wherein said keel means is hollow substantially throughout its radial extent and further comprising flowable ballast partially filling said keel means, wherein when said keel means is in a raised position with the radial extremity of said keel means above said keel axis, said ballast flows radially inward, in response to gravitational forces, toward said keel axis for reducing the forces required by said second positioning means for maintaining said keel means in said raised position.

7. The apparatus of claim 2, wherein each of said port and starboard facing keel sections is hollow substantially throughout its radial extent, and further comprising flowable ballast partially filling each said keel section, wherein when a keel section is in a raised position with the radial extremity of said keel section above said keel axis, said ballast flows radially inward, in response to gravitational forces, toward said keel axis for reducing the force required by the associated actuator for maintaining the keel section in said raised position.

8. The apparatus of claim 1, wherein said keel means has port and starboard facing sides and wherein said second positioning means comprises a port keel means positioning actuator coupled to the port facing side of said keel means and a starboard keel means positioning actuator coupled to the starboard facing side of said keel means.

9. The apparatus of claim 8, wherein said port and starboard keel means positioning actuators respectively comprise opposed port and starboard hydraulic slave cylinders, said apparatus further comprising port and starboard hydraulic master cylinders within said boat respectively hydraulically coupled to said port and starboard slave cylinders, each of said master cylinders having a piston, mechanical control means coupled between the pistons of said port and starboard master cylinders for simultaneously increasing the hydraulic volume of a selected one of said master cylinders and decreasing the hydraulic volume of the other of said master cylinders for rotating said keel means angularly in a selected direction.

10. In a boat, combined attitude control and trailering means comprising: a generally longitudinally directed keel axis mounted at a medial point on the underside of said boat, port and starboard facing angularly opposed keel sections mounted for independent angular positioning about said keel axis; port and starboard keel section positioning actuators respectively coupled to said port and starboard facing keel sections for independently angularly positioning said keel sections about said keel axis for attitude control of said boat; the end of each keel section being configured to engage the axle of removeable tractive wheel to enable the boat to be supported and moved on land.

11. The apparatus of claim 10, wherein said port and starboard keel section positioning actuators respectively comprise opposed port and starboard hydraulic slave cylinders; said apparatus further comprising port and starboard hydraulic master cylinders within said boat respectively hydraulically coupled to said port and starboard slave cylinders each of said master cylinders having a piston, first control means coupled between the pistons of said port and starboard master cylinders for simultaneously increasing the hydraulic volume of a selected one of said master cylinders and decreasing the hydraulic volume of the other of said master cylinders for selectively causing said port and starboard facing keel sections to rotate angularly in the same direction about said keel axis, and second control means comprising hydraulic pump means coupled hydraulically to each of said master cylinders for selectively causing said port and starboard facing keel sections to rotate angularly in opposite directions about said keel axis.

12. The apparatus of claim 10, wherein said port and starboard keel section positioning actuators comprise cylinders being directed for angularly downwardly rotating said keel sections in response to an excess of hydraulic pressure with respect to air pressure and angularly upwardly rotating said keel sections in response to an excess of air pressure with respect to hydraulic pressure; control means within said boat coupled for applying selected hydraulic pressures to said cylinders; and air pressure storage tank means within said boat coupled for applying air pressure to said cylinders; whereby said keel sections may be raised in opposite directions by air pressure from said storage tank means upon the application of no or relatively small hydraulic pressures from said control means.

13. The apparatus of claim 10, wherein each of said port and starboard facing keel sections is hollow substantially throughout its radial extent, and further comprising flowable ballast partially filling each said keel section, wherein when a keel section is in a raised position with the radial extremity of said keel section above said keel axis, said ballast flows radially inward toward said keel axis for reducing the force required by the associated actuator for maintaining the keel section in said raised position.

14. In a boat, attitude control apparatus comprising: a generally longitudinally directed keel axis mounted at a medial point on the underside of said boat, a keel means pendant from said keel axis for angulation about said keel axis; said keel means having port and starboard facing sides, port and starboard facing shock absorber means comprising port and starboard facing tracks respectively in the port and starboard facing sides of said keel means, said tracks being directed radially from said keel axis, and port and starboard facing sliders captured respectively in said port and starboard facing tracks, said tracks and sliders being configured to cooperate with ambient water about said keel means, to produce viscous frictional forces opposing movement of said sliders along said tracks; arising from ambient water displaced by the movement of said sliders being forced through relatively narrow openings in said tracks; and port and starboard actuators respectively connected to said port and starboard facing sliders for positioning said keel means angularly about said keel axis.

15. The apparatus of claim 14, wherein said keel means is hollow substantially throughout its radial extent and further comprising flowable ballast partially filling said keel means, wherein when said keel means is in a raised position with the radial extremity of said keel means above said keel axis, said ballast flows radially inward, in response to gravitational forces, toward said keel axis for reducing the force required by said port and starboard actuators for maintaining said keel means in said raised position.

16. The apparatus of claim 15, wherein said keel means comprises port and starboard facing angularly opposed keel sections each independently angularly positionable about said keel axis, said port and starboard facing shock absorber means being respectively carried by said port and starboard facing keel sections.

17. The apparatus of claim 16, wherein the end of each keel section is configured to carry the axle of a removeable tractive wheel to enable the boat to be supported and moved on land.

18. The apparatus of claim 16, wherein said port and starboard actuators respectively comprise opposed port and starboard hydraulic slave cylinders; said apparatus further comprising port and starboard hydraulic master cylinders within said boat respectively hydraulically coupled to said port and starboard slave cylinders each of said master cylinders having a piston, first control means coupled between the pistons of said port and starboard master cylinders for simultaneously increasing the hydraulic volume of a selected one of said master cylinders and decreasing the hydraulic volume of the other of said master cylinders for selectively causing said port and starboard facing keel sections to rotate angularly in the same direction about said keel axis, and second control means comprising hydraulic pump means coupled hydraulically to each of said master cylinders for selectively causing said port and starboard facing keel sections to rotate angularly in opposite directions about said keel axis.

19. The apparatus of claim 16 wherein, said port and starboard actuators comprise cylinders for receiving opposed hydraulic and air pressures, said cylinders being directed for angularly downwardly rotating said keel sections in response to an excess of hydraulic pressure with respect to air pressure and angularly upwardly rotating said keel sections in response to an excess of air pressure with respect to hydraulic pressure; control means within said boat coupled for applying selected hydraulic pressures to said cylinders; and air pressure storage tank means within said boat coupled for applying air pressure to said cylinders; whereby said keel sections may be raised in opposite directions by air pressure from said storage tank means upon the application of no or relatively small hydraulic pressures from said control means.

20. In a boat, attitude control apparatus comprising: a generally longitudinally directed keel axis mounted at a medial point on the underside of said boat; a keel means, comprising angularly opposed independently positionable port and starboard keel sections, pendant from said keel axis for angulation about said keel axis; port and starboard keel section positioning actuators respectively coupled to said port and starboard keel sections for independently angularly positioning said port and starboard keel sections about said keel axis, said port and starboard keel sections positioning actuators respectively comprising opposed port and starboard hydraulic slave cylinders; said apparatus further comprising port and starboard hydraulic master cylinders within said boat respectively hydraulically coupled to said port and starboard slave cylinders, each of said master cylinders having a piston, and control means coupled between the pistons of said port and starboard master cylinders for selectively simultaneously increasing the hydraulic volume of a selected one of said master cylinders and decreasing the hydraulic volume of the other of said master cylinders, for selectively causing said port and starboard keel sections to rotate in the same direction, and hydraulic means coupled hydraulically to each of said master cylinders for selectively causing said port and starboard keel sections to rotate angularly in opposite directions.

21. The apparatus of claim 20 wherein, said port and starboard slave cylinders are configured for receiving opposed hydraulic and air pressures, said slave cylinders being directed for angularly downwardly rotating said keel sections in response to an excess of hydraulic pressure with respect to air pressure and angularly upwardly rotating said keel sections in response to an excess of air pressure with respect to hydraulic pressure, said hydraulic pressures being supplied to said port and starboard slave cylinders respectively by said port and starboard master cylinders; and an air pressure storage tank means within said boat coupled for applying air pressure to said slave cylinders, whereby said keel sections may be raised in opposite directions by air pressure from said storage tank means in response to the supply to said slave cylinders of no or relatively small hydraulic pressures from said master cylinders.

22. The apparatus of claim 20, wherein the end of each keel section is configured to carry the axle of a removable tractive wheel to enable the boat to be supported and moved on land.

23. The apparatus of claim 20, wherein each of said port and starboard facing keel sections is hollow substantially throughout its radial extent, and further comprising flowable ballast partially filling each said keel section, wherein when a keel section is in a raised position with the radial extremity of said keel section above said keel axis, said ballast flows radially inward toward said keel axis for reducing the force required by the associated slave cylinder for maintaining the keel section in said raised position.

24. In a boat, attitude control apparatus comprising: a generally longitudinally directed keel axis mounted at a medial point on the underside of said boat, port and starboard facing angularly opposed keel sections mounted for independent angular positioning about said keel axis; port and starboard keel section positioning actuators respectively coupled to said port and starboard facing keel sections for angularly positioning said keel sections about said keel axis, said port and starboard keel section positioning actuators comprising cylinders for receiving opposed hydraulic and air pressures, said cylinders being directed for angularly downwardly rotating said keel sections in response to an excess of hydraulic pressure with respect to air pressure and angularly upwardly rotating said keel sections in response to an excess of air pressure with respect to hydraulic pressure; control means within said boat coupled for applying selected hydraulic pressures to said cylinders and air pressure storage tank means within said boat coupled for applying air pressure to said cylinders; whereby said keel sections may be raised in opposite directions by air pressure from said storage tanks upon the application of no or relatively small hydraulic pressure from said control means.

25. The apparatus of claim 24 wherein, the end of each keel section is configured to carry the axle of a removable tractive wheel to enable the boat to be supported and moved on land.

26. The apparatus of claim 24 wherein, each of said port and starboard facing keel sections is hollow substantially throughout its radial extent, and further comprising flowable ballast partially filling each said keel section, wherein when a keel section is in a raised position with the radial extremity of said keel section above said keel axis, said ballast flows radially inward toward said keel axis for reducing the force required by the associated actuator for maintaining the keel section in said raised position.

* * * * *